US009278246B2

(12) United States Patent
Tambornino et al.

(10) Patent No.: US 9,278,246 B2
(45) Date of Patent: Mar. 8, 2016

(54) MODULAR UPRIGHT FOR FITNESS APPARATUS

(71) Applicant: Dynamic Fitness & Strength, LLC, Eau Claire, WI (US)

(72) Inventors: Jason Tambornino, Chippewa Falls, WI (US); Curt Tambornino, Altoona, WI (US)

(73) Assignee: Dynamic Fitness & Strength, LLC, Eau Claire, WI (US)

( * ) Notice: Subject to any disclaimer, the term of this patent is extended or adjusted under 35 U.S.C. 154(b) by 0 days.

(21) Appl. No.: 14/488,011

(22) Filed: Sep. 16, 2014

(65) Prior Publication Data

US 2015/0076092 A1 Mar. 19, 2015

Related U.S. Application Data

(60) Provisional application No. 61/878,310, filed on Sep. 16, 2013.

(51) Int. Cl.

*A47F 7/00* (2006.01)
*A47B 43/00* (2006.01)
*A47B 47/00* (2006.01)

(Continued)

(52) U.S. Cl.

CPC ..... *A63B 21/078* (2013.01); *A47B 47/0083* (2013.01); *A47B 81/007* (2013.01); *A47B 96/145* (2013.01); *A47B 96/1408* (2013.01); *A47B 96/1433* (2013.01); *A47B 96/1458* (2013.01); *A47F 5/01* (2013.01);

(Continued)

(58) Field of Classification Search

CPC ..... A63B 21/078; A63B 21/06; A63B 23/04; A63B 2210/50; A63B 21/00047; A63B 17/04; A47B 47/00; A47B 47/0083; A47B 47/02; A47B 47/021; A47B 47/022; A47B 47/045; A47B 57/00; A47B 57/06; A47B 57/30; A47B 81/00; A47B 81/007; A47B 96/14; A47B 96/1408; A47B 96/1433; A47B 96/145; A47B 96/1458; A47F 5/08; A47F 5/10; A47F 5/101; A47F 5/103; A47F 7/0021; A47F 7/0035; A47F 7/14; A47F 7/17; Y10T 29/49947

USPC ..... 211/44, 85.7, 189, 190, 191, 192, 193, 211/175, 103, 187, 207, 204, 206, 13.1, 211/182; 482/94, 104; 248/121, 127, 158, 248/161, 410, 159, 157, 163.1, 165

See application file for complete search history.

(56) References Cited

U.S. PATENT DOCUMENTS 1,299,677 A * 4/1919 Carroll ..... B21C 47/26 211/206
1,917,764 A * 7/1933 Howie ..... A47B 47/027 220/4.01

(Continued)

*Primary Examiner* — Jennifer E Novosad
(74) *Attorney, Agent, or Firm* — Shewchuk IP Services, LLC; Jeffrey D. Shewchuk

(57) ABSTRACT

A modular upright for an exercise equipment superstructure has a base with a floor plate and a stub, a lower tubular upright portion, a connector and an upper tubular upright portion. The lower tubular upright portion and the upper tubular upright portion both have openings defined at regular intervals along their length for supporting exercise equipment accessories, as well as correspondingly positioned openings in the stub and the connector so fasteners can be used for connection of the components. The stub, the upright portions and the connector are all formed of tubing, sized so none of the columnar load stresses the connector or the stub or the fasteners.

20 Claims, 3 Drawing Sheets

(51) Int. Cl.

| | |
|---|---|
| ***A47B 57/00*** | (2006.01) |
| ***A63B 21/078*** | (2006.01) |
| ***A47B 96/14*** | (2006.01) |
| ***A47F 5/01*** | (2006.01) |
| ***A47B 81/00*** | (2006.01) |
| ***A63B 17/04*** | (2006.01) |
| ***A63B 21/00*** | (2006.01) |

(52) U.S. Cl.
CPC ..... *A63B 17/04* (2013.01); *A63B 21/00047* (2013.01); *A63B 2210/50* (2013.01); *Y10T 29/49947* (2015.01)

(56) References Cited

U.S. PATENT DOCUMENTS 4,657,246 A * 4/1987 Salyer ..... A63B 21/0611 482/94
4,765,616 A * 8/1988 Wolff ..... A63B 21/078 482/104
4,895,381 A * 1/1990 Farlow ..... A47F 7/30 108/106
4,934,015 A * 6/1990 Mink ..... A47L 4/04 15/268
4,974,839 A * 12/1990 Cantor ..... A63B 21/078 482/104
5,306,220 A * 4/1994 Kearney ..... A63B 23/00 482/104
5,346,448 A * 9/1994 Sollo ..... A63B 21/00181 482/104
5,535,898 A * 7/1996 Burgess, Sr. ..... B62B 3/108 211/189
5,556,064 A * 9/1996 Cowe ..... A63B 55/04 211/175
5,653,349 A * 8/1997 Dana ..... F16B 12/34 211/189
5,660,637 A * 8/1997 Dodge ..... B05B 13/0285 118/500
5,954,619 A * 9/1999 Petrone ..... A63B 21/078 482/104
6,669,213 B2 * 12/2003 Woerner ..... B62B 3/002 280/47.35
6,959,824 B1 * 11/2005 Alperson ..... A47F 5/137 211/1.3
7,753,830 B1 * 7/2010 Marsh ..... A63B 21/078 482/104
7,866,494 B1 * 1/2011 Emile ..... A47G 25/0671 211/182
D635,206 S * 3/2011 Henniger ..... D21/691
D636,038 S * 4/2011 Henniger ..... D21/691
D636,039 S * 4/2011 Henniger ..... D21/691
D636,040 S * 4/2011 Henniger ..... D21/691
8,919,582 B1 * 12/2014 Kmetz, III ..... B62B 5/00 211/85.8
2001/0034289 A1 * 10/2001 Parrillo ..... A63B 23/035 482/94
2003/0127407 A1 * 7/2003 Gruber ..... A47B 47/027 211/189
2003/0168487 A1 * 9/2003 Lane ..... B60R 9/06 224/499
2003/0178382 A1 * 9/2003 Tucker ..... A47B 96/061 211/85.7
2012/0329613 A1 * 12/2012 Schiano ..... A63B 21/078 482/94
2013/0065738 A1 * 3/2013 Henniger ..... A63B 21/0724 482/104
2013/0213917 A1 * 8/2013 Rios Garcia Prieto .. A63B 3/00 211/182
2014/0339183 A1 * 11/2014 Cash ..... A47B 81/007 211/85.5
2015/0076092 A1 * 3/2015 Tambornino ..... A63B 21/078 211/85.7

* cited by examiner

MODULAR UPRIGHT FOR FITNESS APPARATUS

CROSS-REFERENCE TO RELATED APPLICATION(S)

The present application claims priority from Provisional Application No. 61/878,310, filed Sep. 16, 2013 and entitled "Modular Upright For Fitness Apparatus". The contents of U.S. provisional patent application Ser. No. 61/878,310 are hereby incorporated by reference in entirety.

FIELD OF THE INVENTION

The present fitness equipment superstructures, and component parts used to assemble and make fitness equipment superstructures.

BACKGROUND OF THE INVENTION

Fitness equipment superstructures, also referred to as "rack and rig" systems, are in general known in the art. Examples are shown in U.S. Pat. Nos. 4,657,246, D635,206, D636,038, D636,039 and D636,040, U.S. Patent Pub. No 2013/0065738 and U.S. patent application Ser. No. 14/327,319, all incorporated by reference. These systems are mainly for and used in cross fit gyms, pull up rigs, and other athletic/exercise facilities.

One of the basic components is the columns or uprights used in constructing the superstructure. Generally speaking, each upright is constructed from a steel (or other strong metal) tube, such as a 2×2, 2×3 or 3×3 inch rectangular tube, which has a number of holes formed along its length. These tubes typically have about an 8 or a 9 foot length, with the tube welded at one of its ends to a flat base plate. The flat base plate typically includes bolt holes (such as four per upright/base plate) for bolting to the floor. The holes along the length of the upright are for attaching cross-member bars, J-cups and other accessories and hardware.

Separate from the uprights used in fitness equipment superstructures but in the field of fitness equipment, other fitness equipment commonly has uprights which are constructed to be adjustable in height, such as in the weight bench of U.S. Pat. No. 4,765,616. A common way to make adjustable height uprights is to use telescoping tubes, having a series of through-holes along one or both of the tubes' lengths, with a pin which is placed into aligned through-holes to hold the telescoping tubes relative to each other. One shortcoming of telescoping tubes of such structures is that one of the telescoping tubes is smaller in width (to fit within the wider tube), and therefore weaker (assuming the same wall thickness). To be able to support significant weight with the smaller tube, often the larger tube is over-designed, i.e., bigger, stronger, heavier and more costly than necessary.

Outside the fitness equipment field entirely, other structures have uprights which are required to be transportable and therefore are designed for ease of assembly and disassembly, such as the uprights used in tents. To allow tubular uprights to be shorter during transport, often the uprights include a short telescoping section which is either wider or narrower than the mating end of the adjacent tube section. During assembly, the narrower end of one tube is inserted into the wider end of the attaching tube. However, such other structures often are not required to support the vertical and bending loads which are placed on fitness equipment superstructures. Significant vertical overloads on such assembled uprights can cause the smaller end to wedge too tightly into the larger adjacent tube, causing damage or making disassembly difficult or impossible. This type of "telescoping end" construction has accordingly not found favor in fitness equipment superstructures.

Instead, fitness equipment superstructures have remained with long—often 8 or 9 foot—uprights of single piece construction. Such long uprights, though functional in use, are difficult to transport, being both heavy and longer than many vehicle beds. The long uprights are also expensive, and it is often difficult and costly to replace a long upright should one become damaged. Better solutions are needed.

BRIEF SUMMARY OF THE INVENTION

The present invention is a modular upright for an exercise equipment superstructure, a method for assembling such an upright, and an exercise equipment superstructure using such an upright. The modular upright includes a base having a floor plate and a stub, a lower tubular upright portion, a connector and an upper tubular upright portion. The stub, the upright portions and the connector are all formed of tubing, fitting inside each other and having correspondingly spaced holes to be connected by fasteners. The upper tubular upright portion is the same cross-sectional shape and size as the lower tubular upright portion with abutting ends, and a lower end of the lower tubular upright portion directly rests on the floor plate, so none of the columnar load stresses the fasteners, the connector or the stub. The lower tubular upright portion and the upper tubular upright portion both have openings defined at regular intervals along their length for supporting exercise equipment accessories. The upright and fitness equipment superstructure is thus more convenient to crate and transport, while appropriately supporting the load of the fitness equipment.

BRIEF DESCRIPTION OF THE DRAWINGS

In FIGS. 1, 6, and 7, the hole numbering has been omitted for drawing clarity.

While the above-identified drawing figures set forth a preferred embodiment, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION

Figure 1:
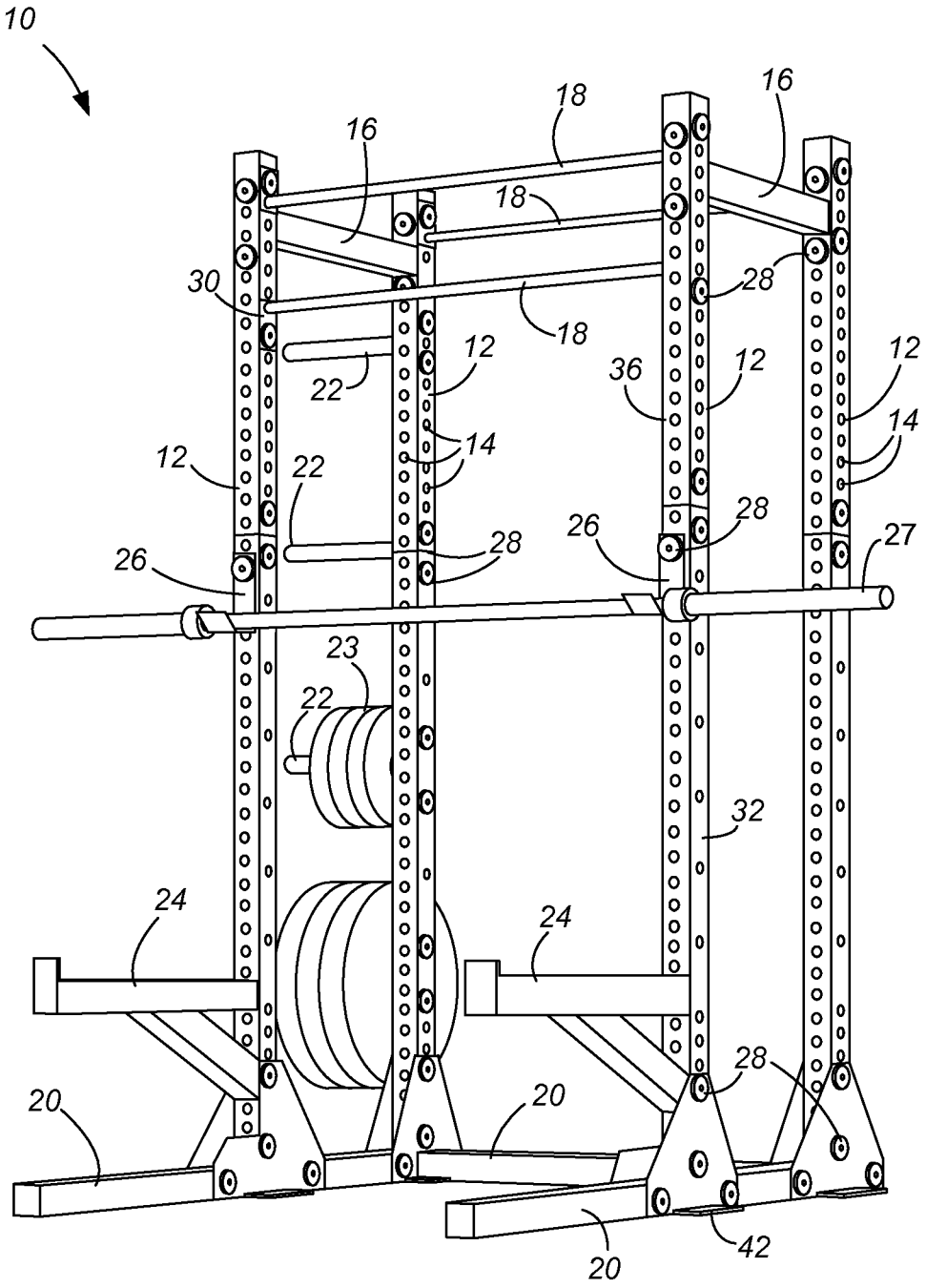
FIG. 1 is a perspective view of an exemplary fitness superstructure using four of the preferred uprights of the present invention.

As shown in FIG. 1, a fitness equipment superstructure 10 has, in this example, four columns or uprights 12. In this preferred embodiment, each of the uprights 12 is formed with a rectangular horizontal cross-section, such as from 3×3 inch metal tubing. The preferred uprights 12 are about 8 or 9 feet long (shown as 9 feet long), formed from rectangular steel tubing with a peripheral wall thickness of about 0.13 inches.

Figures 2, 3, 4, 5:
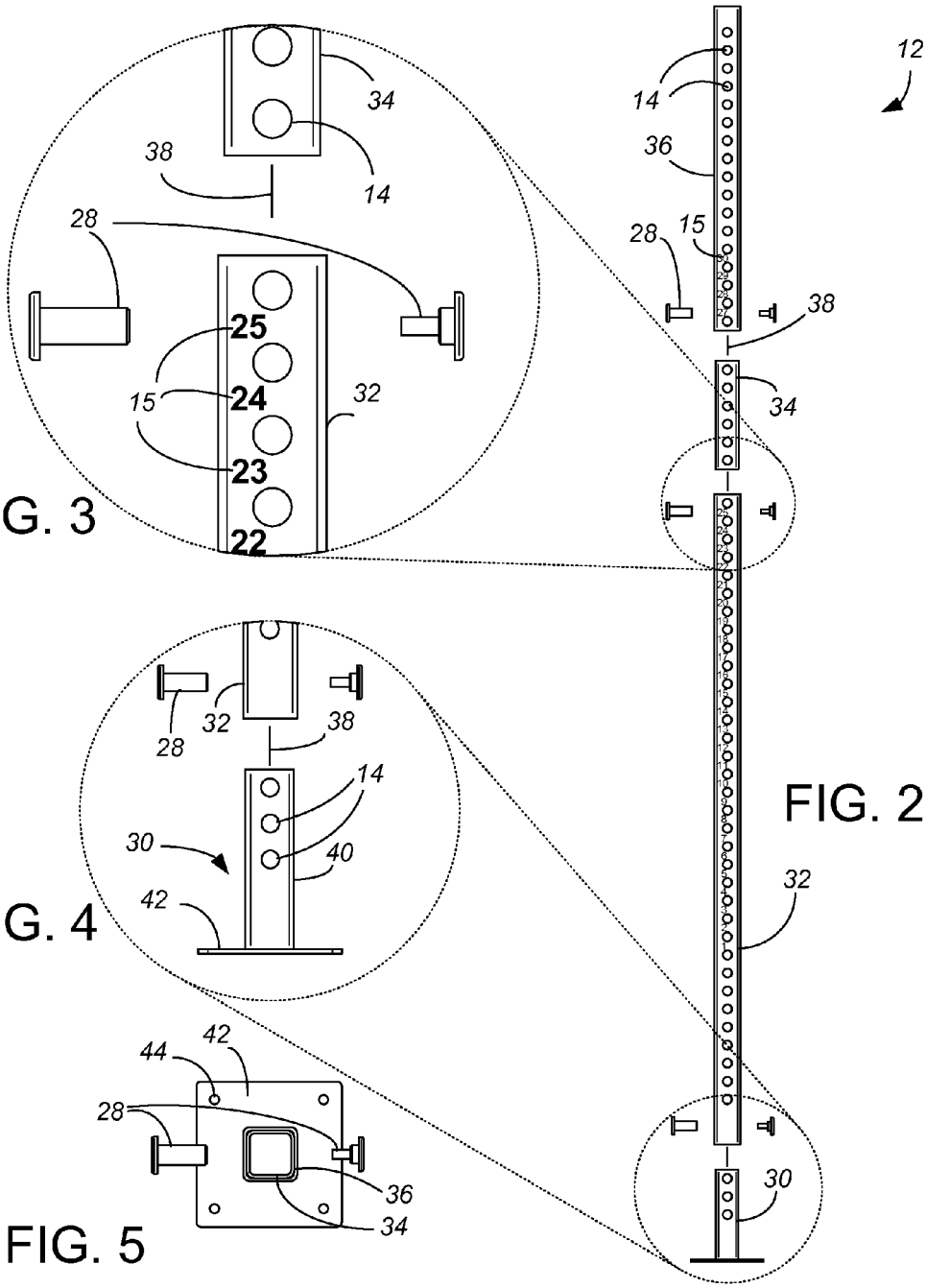
FIG. 2 is an exploded side view of one of the uprights of FIG. 1.
FIG. 3 is an enlargement of a portion of FIG. 2 showing the upper end of the lower upright portion and the lower end of the connector.
FIG. 4 is an enlargement of a portion of FIG. 2 showing the base and the lower end of the lower upright portion.
FIG. 5 is a plan view of the upright of FIG. 4.
Figures 6, 7, 8:
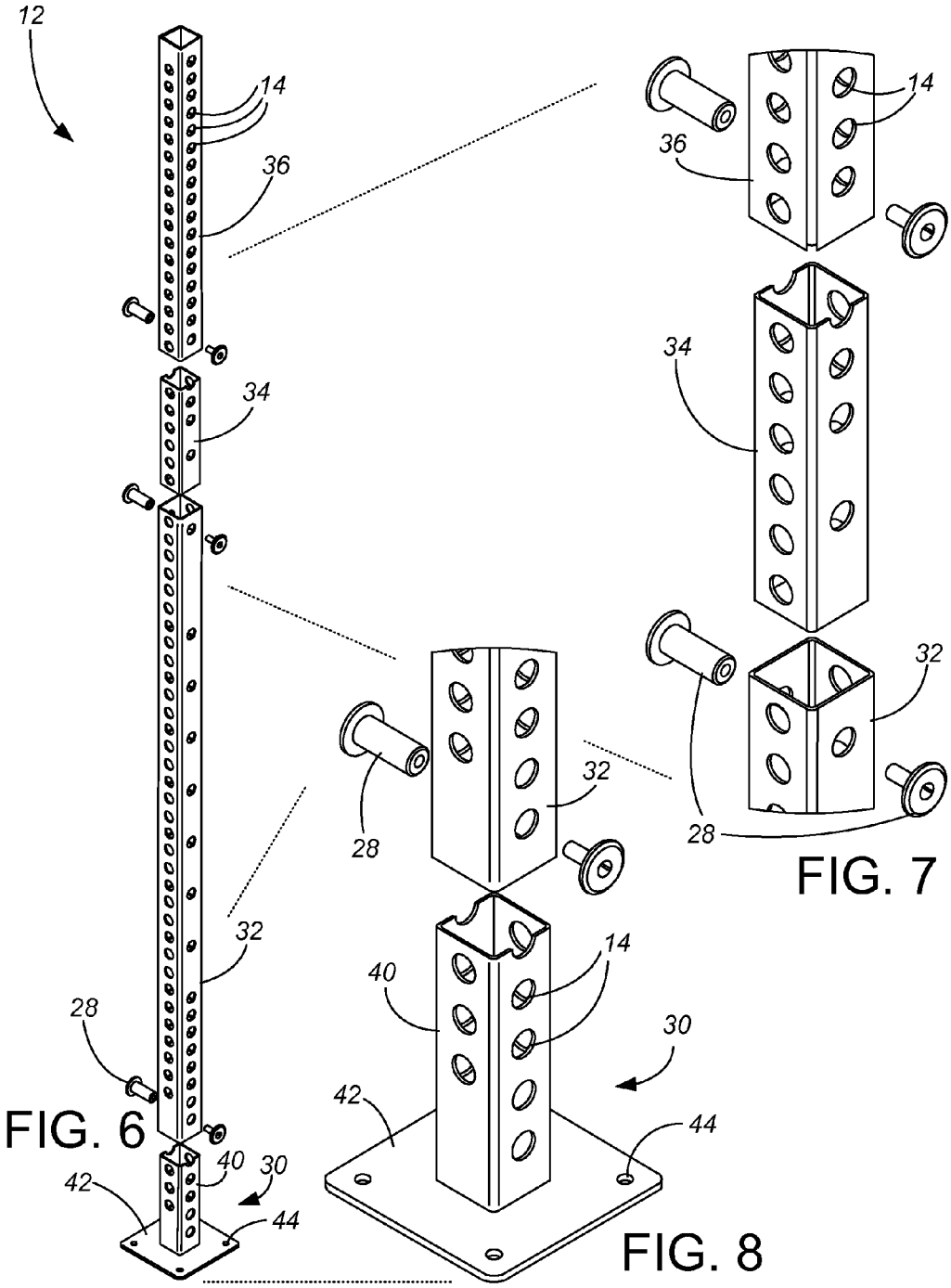
FIG. 6 is an exploded perspective view of the upright of FIG. 2.
FIG. 7 is an enlargement of a portion of FIG. 6 showing the upper end of the lower upright portion and the lower end of the connector.
FIG. 8 is an enlargement of a portion of FIG. 6 showing the base and the lower end of the lower upright portion.

Each upright 12 has a series of holes 14 running along its height, which can be used to fasten supports and accessories to the uprights 12. The preferred holes 14 are about 1.06 inches in diameter, spaced at regular intervals along the height of the upright 12, such as at about 2 inch and about 6 inch intervals as desired for mounting hardware to and assembling the fitness equipment superstructure 10. Slightly different sized holes can be used for fastening supports and accessories, particularly if different sized tubing is used. In the preferred embodiment, indicia such as numbering 15 (or lettering), best shown in FIG. 3, is placed on the uprights 12 so users can more readily determine which hole 14 is which and find it easier to return the superstructure 10 to a particular configuration.

The sets of holes 14 in one direction (front-to-back) are preferably offset at a different elevation than the closest sets of holes 14 in the other direction (side-to-side). This allows the holes 14 in both directions to be simultaneously used for mounting hardware and accessories, because fasteners in one direction (front-to-back) are at a different elevation and do not interfere with fasteners in the other direction (side-to-side). Alternatively, some or all of the sets of holes 14 may be at the same elevation in both directions (front-to-back and side-to-side), with the general result that only the holes 14 in one direction at that elevation are used in any given configuration of superstructure.

In this example, the uprights 12 are attached together at their tops with two rectangular cross-bars 16 running from front-to-back, as well as three smaller circular cross-bars 18 running from side-to-side, two in front and one in back. The circular cross-bars 18 can be used, for instance, for pull-ups or similar exercises. The bases of the uprights 12 are secured together with floor beams 20. One of the rear uprights 12 is shown with a series of four weight pegs 22 attached. The weight pegs 22 can be used to hold weightlifting plate free-weights 23 as known in the art. Bench or seat supports 24 are attached extending forward from each of the front uprights 12. J-cups 26, which can be used to support a weightlifting bar 27, are attached facing forward from each of the front uprights 12. It can readily be understood that a wide variety of different configurations of fitness equipment superstructure set-ups can be achieved with these and similar uprights and accessories, including many configurations which use more than four uprights 12.

In this preferred embodiment, each of the attachments to the uprights 12 are achieved with one or more fasteners 28. The preferred fastener 28 is shown in more detail in U.S. patent application Ser. No. 14/327,319 filed Jul. 9, 2014, incorporated by reference.

The construction of the uprights 12 is better shown with reference to FIGS. 2-8. The single piece upright of the prior art is replaced with a four piece (plus three fasteners 28) assembly. The four pieces of each upright 12 include a base 30, a lower tubular upright portion 32, a connector 34 and an upper tubular upright portion 36. When assembled, each of these four pieces 30, 32, 34, 36 has its longitudinal axis 38 aligned and extending generally vertically.

Like the fasteners 28 used to attach accessories, the three fasteners 28 used in the uprights 12 may also be as described in U.S. patent application Ser. No. 14/327,319. Alternatively, the fasteners may simply be bolts of sufficient diameter and length to mate with the holes 14, together with corresponding nuts as well as any washers. The fasteners 28 are preferably removable so the superstructure 10 can be disassembled, such as for reassembling in a different configuration, for transporting and reassembling in a different location, or for replacing/repairing only a portion of the superstructure 10.

The base piece 30 includes a smaller size stub 40 joined to a relatively thick and sturdy floor plate 42. In the preferred embodiment, the joining of the stub 40 to the floor plate 42 is by welding. The length of the stub 40 is chosen based upon welding and handling convenience as well as based upon the amount of bending moment required to be transferred between the base 30 and the upright 12 during use of the superstructure 10. In the preferred embodiment, the stub 40 is 10 inches long, welded to a ¼ inch thick floor plate 42. As compared to the prior art, having the stub 40 be much shorter than the full upright 12 (10 inches rather than 9 feet) makes the welding operation much easier and relieves stress on the welded joint during manufacturing and assembly of the superstructure 10. In the preferred embodiment when using 3×3 inch wide uprights 12, the stub 40 is formed of 2.73 inch wide square tubing, again using tubing with a wall thickness of about 0.13 inches. Alternatively, the stub 40 could be formed out of a solid metal bar rather than tubing, or could be formed wider than the lower tubular upright portion 32. Forming the stub 40 out of tubing rather than solid metal, and narrower so it fits inside the lower tubular upright portion 32, lightens the base 30 and is generally less expensive.

The preferred stub 40 does not carry any of the columnar (vertical) load, which is instead transferred directly and entirely from the lower upright portion 32 to the floor plate 42, so the fact that the stub 40 is narrower than the lower upright portion 32 does not create a point of weakness in the design. The stub 40 does, however, need to be long enough, with a strong enough connection to the floor plate 42, to support any moments (such as when an upright 12 is leaning or cantilevering a weight 23) between the floor plate 42 and the lower upright portion 32. In the preferred embodiment, the stub 40 extends for more than 8% of the height of the upright 12. A longer overlapping length between the stub 40 and the lower end of the lower upright portion 32 can withstand and transfer greater bending moments between the floor plate 42 and the lower upright portion 32.

Care should be taken with the welded joint in the base 30 to ensure a clean outer edge. With a clean weld, a flat end edge of the peripheral wall of the lower tubular upright portion 32 abuts the floor plate 42 directly, with the result that the entire vertical column load of the lower tubular upright portion 32 is transferred directly to the floor plate 42.

The horizontal dimensions of the floor plate 42 should be selected based upon the expected amount of moment which needs to be transferred from the floor to the upright 12. In the preferred embodiment, and similar to prior art uprights, the floor plate 42 is square, and about 8 inches wide. This size of floor plate 42 is adequate during assembly to keep the upright 12 from falling over even if the floor is not entirely horizontal or the upright 12 is slightly bumped. In use, the upright 12 is attached in a superstructure 10 with other uprights 12, spaced so the entire superstructure 10 will not tip over. Bolt holes 44 are positioned in the corners of the floor plate 42 should it be desired to bolt the superstructure 10 to the floor, such as to avoid inadvertent or undesired moving of the superstructure 10. Different sizes and shapes of floor plates can alternatively be used.

The preferred stub 40 is formed with three sets of fastener through-holes 14 in one direction, and four and a half sets of fastener through-holes 14 in the other direction. The "half" set of fastener through-holes 14 is due to the upper edge of the stub 40 intersecting an accessory attachment through hole. Each of these sets of through-holes 14 extends generally horizontally relative to the vertically upward direction that the stub 40 extends from the floor plate 42. The lowest of these through-holes 14, with its center 2 inches from the bottom of the stub 40, mating with the lowest of the through-holes 14 through the lower tubular upright portion 32, is used with a fastener 28 for securing the lower tubular upright portion 32 to the base 30. The remainder of the through-holes 14 through the stub 40 mate with corresponding through-holes 14 in the lower tubular upright portion 32 for attachment of accessories or attachment of other parts of the superstructure 10.

The lower upright portion 32 is at least 30 inches and less than 8 feet in length, leading to ease of transportation. In the preferred embodiment, the lower upright portion 32 is a 6 foot long tubular piece. The upper upright portion 36, preferably also at least 30 inches in length, is no longer than the lower upright portion 32, and preferably 35-80% of the length of the lower upright portion 32. By making the upper upright portion 36 shorter than the lower upright portion 32, less bending stress is placed on the connector 34. In the most preferred embodiment, the upper upright portion 36 is about 50% of the length of the lower upright portion 32. Having the upper upright portions 36 be half the length of the lower upright portion 32 also makes for convenient storage and shipment, such as in a six foot long box/crate with two upper upright portions 36 aligned end-to-end in the box/crate. In the preferred embodiment shown, the upper upright portion 36 is a 3 foot long tubular piece, but alternatively could be a 4 foot or 6 foot long tubular piece on top of the lower upright portion 32.

The main lower and upper sections 32, 36 are formed of the identically sized tubing stock, with ends that abut each other after assembly. Alternatively, the upper upright portions 36 could be made of slightly thinner walled tubing than the lower upright portions 32, as the upper upright portions 36 will necessarily carry less load. In the preferred embodiment, the connector 34 is formed from identically sized tubing to the stub 40. By forming both the upper upright portions 36 and the lower upright portions 32 out of the same tubing stock, and by forming both the stubs 40 and the connectors 34 out of the same smaller tubing stock sized to mate inside the peripheral wall of the tubular upright portions 32, 36, fewer types of tubing stock are required. Alternatively, the connector 34 could be wider than the upper and lower upright portions 32.

In the preferred embodiment, the junction between the lower and upper sections 32, 36 is horizontal. By having horizontal abutting ends, the columnar (vertical) load of the upper upright portion 36 is transferred directly and entirely to the lower upright portion 32, with none of the columnar (vertical) load carried by the connector 34, so the fact that the connector 34 is narrower than the lower upright portion 32 does not create a point of weakness in the design.

The connector 34 is shorter than the lower upright portion 32 and shorter than the upper upright portion 36. The connector 34 does, however, need to be long enough into each of the lower upright portion 32 and the upper upright portion 36 to support any moments between the two upright portions 32, 36. More preferably, the connector 34 extends for more than 5% of the height of and inside each of the lower upright portion 32 and the upper upright portion 36. In the preferred embodiment, the connector 34 extends for 6 inches (i.e., about 8%) inside the lower upright portion 32 and for 6 inches (i.e., about 17%) inside the upper upright portion 36. The 6 inch overlapping length is suitable for transferring the bending moments/stresses placed on the uprights 12 of the superstructure 10 during assembly and use.

Alternatively, the connector 34 could be formed out of a solid metal bar rather than tubing, or could be formed wider than the lower and upper tubular upright portions 32, 36. Forming the connector 34 out of tubing rather than solid metal, and narrower so it fits inside the lower and upper tubular upright portion 32, 36, lightens the connector 34 and is generally less expensive. Positioning the stub 40 and the connector 34 inside the lower and upper main tubes 32, 36 also allows the same hardware to be used throughout (such as fasteners/bolts with a length for the 3" tube) and provides a clean look to the assembled upright 12 with fewer projecting corners (to minimize the risk of athlete injury).

The connector 34 has holes 14 formed in its side walls that match the location, size and spacing of the holes 14 in the side walls of the upright tubular portions 32, 36. The preferred connector 34 is formed with six sets of fastener through-holes 14 in one direction and three and a half sets of fastener through-holes 14 in the other direction. The "half" set of fastener through-holes 14 is due to an edge of the connector 34 intersecting an accessory attachment through hole.

The base 30, lower upright portion 32, connector 34, and upper upright portion 36 are all preferably formed of a strong metal, such as carbon steel with a powder coated finish. The preferred floor plate 42 is formed of ASTM A36 steel plate, and the preferred stub 40, lower upright portion 32, connector 34, and upper upright portion 36 are all formed of ASTM A500 cold formed seamless steel tubing. With the stub 40, lower upright portion 32, connector 34, and upper upright portion 36 all formed from tubing, the holes 14 can be punched, drilled or more preferably cut (such as with a laser cutter) into the tubing.

With neither of the main tubes 32, 36 having a welded base plate, the main tubes 32, 36 fit much closer and more neatly together for stocking, packaging and shipment. Additionally, less stress is placed on the welded joint during stocking, packaging and shipment.

On one (front) side, the holes 14 are numbered (1 through 25 on the main lower section, as shown on FIG. 3, 27 through 30 on the upper section) and evenly spaced at 2 inch intervals to designate attachment heights. The series of indicia 15 thus continues across an interface between the lower tubular upright portion 32 and the upper tubular upright portion 36, and further makes the orientation of parts 32, 36 readily apparent to the assembler. The three fasteners 28 are preferably disposed transversely to the numbered, evenly spaced holes 14. A single fastener 28 is used for each connection. The bottom fastener 28 is positioned only two inches above the floor plate 42, a position that does not interfere with other attachments because it is so low. The two upper fasteners 28 are positioned in holes 14 at about 70" and 74" above the floor. This positioning coincides with a height off the floor (about 6 feet) which is least seldom used for accessories and cross-member bars in standard exercise configurations (i.e., athletes have little or no exercises which are most conveniently performed using a 6 foot cross-bar or accessory). The six foot high connection location is also at a convenient height for workers assembling the superstructure 10, i.e., for holding and positioning the connector 34 into the lower main tube 32 during insertion and tightening of the fastener 28 at the 70" elevation, for raising and positioning the upper main tube 36 onto the connector 34, and during insertion and tightening of the second fastener 28 at the 74" elevation. Other than the three sets of holes 14 used for the fasteners 28, the remaining holes 14 in the stub 40 and the connector 34 are for the purpose of allowing unimpeded access through the holes 14 on the tubular upright portions 32, 36 without interference.

Given the structure described above, the assembly process to form an upright 12 is relatively straightforward. The base 30 is placed on a floor, with the stub 40 extending generally vertically upward from the horizontal plane of the floor plate 42. The lower upright portion 32 is placed over the stub 40 in a mating position, and dropped in place until the lower upright portion 32 rests on the floor plate 42. This placement aligns a set of holes 14 in the stub 40 within a set of holes 14 in the lower upright portion 32, and a fastener 28 is inserted horizontally and attached there through. A connector 34 is placed in a mating position within the peripheral wall of the lower upright portion 32 at its upper end, with a set of through-holes 14 in the connector 34 aligned with a set of through-holes 14 in the lower upright portion 32. A fastener 28 is then inserted horizontally through the aligned sets of holes 14 and tightened, securing the connector 34 in place. Next, an upper upright portion 36 is placed over and in a mating position with the connector 34, and dropped down until the peripheral walls of the upper and lower upright portions 32 abut. This now aligns the longitudinal axes 38 of each of the stub 40, lower upright portion 32, connector 34 and upper upright portion 36. This also now aligns a set of through-holes 14 in the connector 34 with a set of through-holes 14 in the lower end of the upper upright portion 36. A fastener 28 is then inserted horizontally through the aligned sets of holes 14 and tightened, securing the upper upright portion 36 in place. With the ends of the lower upright portion 32 abutting against the floor plate 42 and against the end of the upper upright portion 36, the load of the upright 12 is supported on the floor plate 42 of the base 30 without loading any of the fasteners 28 in shear (other than to support the suspended weight of the connector 34). This assembly process is completed for each of the uprights 12, with any horizontal cross-bars 16, 18 connected between the uprights 12 to form the superstructure 10.

The present invention thus provides an upright 12 and a fitness equipment superstructure 10 which is more convenient to crate and transport, while appropriately supporting the load of the fitness equipment. Each upright 12 can be assembled and disassemble as needed for any change in configuration, including to replace any damaged component. The upright components are less costly to manufacture, while at the same time delivering a strong and robust fitness equipment solution.

Although the present invention has been described with reference to preferred embodiments, workers skilled in the art will recognize that changes may be made in form and detail without departing from the spirit and scope of the invention.

What is claimed is:

1. An upright for an exercise equipment superstructure comprising:

a base comprising:

a floor plate for extending in a horizontal plane, the floor plate having a generally planar bottom surface for resting on a floor and having a top surface; and a stub rigidly connected to the floor plate and extending generally vertically upward from the horizontal plane of the floor plate, the stub leaving at least a portion of the top surface of the floor plate exposed, the stub having at least one horizontally extending through hole defined therein;

a lower tubular upright portion, the lower tubular upright portion having a peripheral wall defining a first longitudinal axis, a lower portion of the peripheral wall mating with the stub of the base such that the base can support the lower tubular upright portion with the first longitudinal axis extending generally vertically, the lower tubular upright portion having a first horizontally extending through hole defined therein and positioned to align with the horizontally extending through hole of the stub while the base supports the lower tubular upright portion on the exposed top surface of the floor plate, the lower tubular upright portion having a second horizontally extending through hole at an upper end when the base supports the lower tubular upright portion;

a connector, shorter than the lower tubular upright portion and sized to mate with the peripheral wall of the lower tubular upright portion at its upper end, the connector having first and second through-holes;

an upper tubular upright portion, the upper tubular upright portion having a peripheral wall defining a second longitudinal axis, the upper tubular upright portion being longer than the connector, a lower end of the peripheral wall of the upper tubular upright portion being sized to mate with the connector, the lower end of the peripheral wall of the upper tubular upright portion having a first through hole, such that the upper tubular upright portion can be in abutting contact with the lower tubular upright portion and supported by the lower tubular upright portion and the connector with a) the second horizontally extending through hole of the lower tubular upright portion being in alignment with the first through hole of the connector;

b) the horizontally extending through hole of the upper tubular upright portion being in alignment with the second through hole of the connector; and c) the second longitudinal axis extending vertically and being generally coaxial with the first longitudinal axis; and fasteners extending through each of the through-holes to attach the base to the lower tubular upright portion, the lower tubular upright portion to the connector, and the connector to the upper tubular upright portion, wherein the fasteners are not substantially loaded in shear and with load of the upper tubular upright portion being transferred directly to the lower tubular upright portion and with load of the lower tubular upright portion being transferred directly to the floor plate;

wherein the lower tubular upright portion and the upper tubular upright portion both have openings defined at regular intervals along their length for supporting exercise equipment accessories.

2. The upright of claim 1, wherein the openings defined at regular intervals along the lower tubular upright portion and the upper tubular upright portion are accessory attachment through-holes.

3. The upright of claim 2, wherein the connector comprises a plurality of through-holes, including a first accessory attachment through hole spaced to align with one of the accessory attachment through-holes of the lower tubular upright portion and a second accessory attachment through hole spaced to align with one of the accessory attachment through-holes of the upper tubular upright portion.

4. The upright of claim 2, wherein the lower tubular upright portion and the upper tubular upright portion each have a rectangular horizontal cross-section, wherein the accessory attachment through-holes are defined on a first two parallel faces of the peripheral wall, and wherein the through-holes for connection to the stub and the connector are defined on a second two parallel faces of the peripheral wall, with the first two parallel faces being normal to the second two parallel faces, and wherein the fasteners are threaded fasteners.

5. The upright of claim 4, wherein accessory attachment through-holes are also defined on the second two parallel faces of the peripheral wall, and wherein the stub comprises an upper edge which intersects an accessory attachment through hole.

6. The upright of claim 5, wherein accessory attachment through-holes on the first two parallel faces of the peripheral wall are offset in elevation relative to accessory attachment through-holes on the second two parallel faces of the peripheral wall, such that fasteners can be simultaneously used in both directions through adjacent accessory attachment through-holes and through the stub.

7. The upright of claim 4, wherein accessory attachment through-holes are also defined on the second two parallel faces of the peripheral wall, and wherein the connector comprises an edge which intersects an accessory attachment through hole.

8. The upright of claim 7, wherein accessory attachment through-holes on the first two parallel faces of the peripheral wall are offset in elevation relative to accessory attachment through-holes on the second two parallel faces of the peripheral wall, such that fasteners can be simultaneously used in both directions through adjacent accessory attachment through-holes and through the connector.

9. The upright of claim 2, wherein the stub comprises a plurality of through-holes, including an accessory attachment through hole spaced to align with one of the accessory attachment through-holes of the lower tubular upright portion.

10. The upright of claim 1, further comprising a series of indicia labeling the openings defined at regular intervals along the lower tubular upright portion and the upper tubular upright portion, wherein the series of indicia continues across an interface between the lower tubular upright portion and the upper tubular upright portion.

11. The upright of claim 1, wherein the lower tubular upright portion and the upper tubular upright portion are both at least 30 inches long.

12. The upright of claim 11, wherein the lower tubular upright portion is longer than the upper tubular upright portion.

13. The upright of claim 12, wherein the lower tubular upright portion is twice as long as the upper tubular upright portion.

14. The upright of claim 1, wherein the stub is a tube which fits inside the lower tubular upright portion.

15. The upright of claim 1, wherein the lower tubular upright portion and the upper tubular upright portion both have the same cross-sectional size and shape, and wherein each fastener is tightenable for tightened contact about its respective lower tubular upright portion or upper tubular upright portion.

16. The upright of claim 1, wherein the connector is a tube which fits inside the lower tubular upright portion and the upper tubular upright portion.

17. A plurality of the uprights of claim 1 assembled as an exercise equipment superstructure, and further comprising an upper horizontal cross-bar connecting two upper tubular upright portions.

18. A process of assembling an exercise equipment superstructure, comprising:

placing a base on a floor, the base comprising:

a floor plate for extending in a horizontal plane, the floor plate having a generally planar bottom surface for resting on the floor and having a top surface; and a stub rigidly connected to the floor plate and extending generally vertically upward from the horizontal plane of the floor plate, the stub leaving at least a portion of the top surface of the floor plate exposed, the stub having at least one horizontally extending through hole defined therein;

placing a lower tubular upright portion in a mating position with the stub of the base, the lower tubular upright portion having a peripheral wall defining a first longitudinal axis, a lower portion of the peripheral wall mating with stub of the base such that the base supports the lower tubular upright portion on the exposed top surface of the floor plate with the first longitudinal axis extending generally vertically, the lower tubular upright portion having a first horizontally extending through hole defined therein and positioned to align with the horizontally extending through hole of the stub while the base supports the lower tubular upright portion, the lower tubular upright portion having a second horizontally extending through hole at an upper end when the base supports the lower tubular upright portion;

attaching a fastener through the first horizontally extending through hole of the lower tubular upright portion and through the horizontally extending through hole of the stub, wherein the fastener is not substantially loaded in shear and with load of the lower tubular upright portion being transferred directly to the floor plate;

placing a connector in a mating position with the peripheral wall of the lower tubular upright portion at its upper end, the connector being shorter than the lower tubular upright portion, the connector having first and second through-holes;

attaching a fastener through the second horizontally extending through hole of the lower tubular upright portion and through the first through hole of the connector;

placing an upper tubular upright portion in a mating position with the connector, the upper tubular upright portion having a peripheral wall defining a second longitudinal axis, the upper tubular upright portion being longer than the connector, a lower end of the peripheral wall of the upper tubular upright portion being sized to mate with the connector, the lower end of the peripheral wall of the upper tubular upright portion having a first through hole, such that the upper tubular upright portion is in abutting contact with the lower tubular upright portion and is supported by the lower tubular upright portion and the connector with a) the horizontally extending through hole of the upper tubular upright portion being in alignment with the second through hole of the connector; and b) the second longitudinal axis extending vertically and being generally coaxial with the first longitudinal axis; and attaching a fastener through the horizontally extending through hole of the upper tubular upright portion and through the second through hole of the connector, wherein both fasteners through the connector are not substantially loaded in shear with load of the upper tubular upright portion being transferred directly to the lower tubular upright portion, to thereby assemble an upright;

wherein the lower tubular upright portion and the upper tubular upright portion both have openings defined at regular intervals along their length for supporting exercise equipment accessories.

19. The process of assembling an exercise equipment superstructure of claim 18, further comprising:

assembling a second upright for the exercise equipment superstructure; and connecting an upper horizontal cross-bar between two upper tubular upright portions of the uprights.

20. The process of assembling an exercise equipment superstructure of claim 18, wherein the attaching of the fasteners is by tightening a threaded connection in the fasteners.

* * * * *